US010745940B2

(12) United States Patent
Barbour et al.

(10) Patent No.: US 10,745,940 B2
(45) Date of Patent: Aug. 18, 2020

(54) UNIVERSAL SWITCH ASSEMBLY FOR LOCKING AND UNLOCKING AN ACCESS DOOR OF A GAMING MACHINE CABINET

(71) Applicant: Aristocrat Technologies Australia Pty Limited, North Ryde, NSW (AU)

(72) Inventors: Timothy Francis Barbour, Nolensville, TN (US); Dominic S. Biondo, Las Vegas, NV (US); Mark Gerard Surra, Las Vegas, NV (US); Stephen William Shaffer, Jr., Las Vegas, NV (US)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 103 days.

(21) Appl. No.: 15/984,886

(22) Filed: May 21, 2018

(65) Prior Publication Data

US 2019/0352934 A1 Nov. 21, 2019

(51) Int. Cl.

| | |
|---|---|
| ***E05B 49/00*** | (2006.01) |
| ***G07F 17/32*** | (2006.01) |
| ***G07C 9/00*** | (2020.01) |

(52) U.S. Cl.

CPC ..... *E05B 49/004* (2013.01); *G07C 9/0073* (2013.01); *G07F 17/3216* (2013.01); *G07F 17/3241* (2013.01); *G07C 2009/00761* (2013.01); *G07C 2009/00793* (2013.01)

(58) Field of Classification Search

CPC . E05B 49/004; G07C 9/0073; G07C 17/3216; G07C 17/3241; G07C 2009/00761; G07C 2009/00793

USPC ..... 109/59 R; 70/DIG. 30

See application file for complete search history.

(56) References Cited

U.S. PATENT DOCUMENTS

| | | | | |
|---|---|---|---|---|
| 4,554,808 | A * | 11/1985 | Escaravage | E05B 77/48 292/201 |
| 4,580,019 | A * | 4/1986 | Takahashi | H01H 27/06 200/43.08 |
| 5,224,707 | A * | 7/1993 | Martin | E05B 39/04 273/143 R |
| 5,450,271 | A * | 9/1995 | Fukushima | G06F 1/1632 248/553 |
| 5,598,323 | A * | 1/1997 | Muller | H01H 9/226 200/43.01 |

(Continued)

FOREIGN PATENT DOCUMENTS

EP 1316927 B1 5/2011

*Primary Examiner* — Suzanne L Barrett

(74) *Attorney, Agent, or Firm* — Armstrong Teasdale LLP

(57) ABSTRACT

An electronic gaming machine includes a cabinet, an access door, an electromechanical latch mechanically coupled to the cabinet and configured to mechanically engage and disengage the access door, and a switch assembly operable to control the electromechanical latch. The switch assembly includes a lock mechanically coupled to the cabinet and extending into the cabinet, a cam mechanically coupled to a rotatable portion of the lock within the cabinet, and a switching element mounted within the cabinet proximate the cam and configured to be mechanically engaged and actuated by the cam when the cam rotates into contact with the switching element, wherein the switching element is electrically connected to the electromechanical latch and is further configured to control the electromechanical latch in response to actuation by the cam.

20 Claims, 5 Drawing Sheets

(56) References Cited

U.S. PATENT DOCUMENTS

| | | | | |
|---|---|---|---|---|
| 6,146,274 | A * | 11/2000 | Salour | G07F 9/06 194/350 |
| 7,758,428 | B2 | 7/2010 | Mattice et al. | |
| 2005/0077995 | A1 | 4/2005 | Paulsen et al. | |
| 2008/0207335 | A1 | 8/2008 | DiMichele | |
| 2017/0030111 | A1 | 2/2017 | Vetter et al. | |

* cited by examiner

UNIVERSAL SWITCH ASSEMBLY FOR LOCKING AND UNLOCKING AN ACCESS DOOR OF A GAMING MACHINE CABINET

TECHNICAL FIELD

The field of disclosure relates generally to electronic gaming, and more particularly to a universal switch assembly for locking and unlocking an access door of an electronic gaming machine cabinet.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards form any winning outcomes are typically added back to the credit balance and can be provided to the player upon completion of a gaming session or when the player wants to "cash out."

Slot games are often displayed to the player in the form of various symbols arranged in a row-by-column grid, or "matrix." Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "paytable" that is available to the player for reference. Often, the player may vary his/her wager to included differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome. Notably, some games may include an element of skill on the part of the player and are therefore not entirely random.

EGMs are commonly secured against unauthorized entry by one or more locking mechanisms, such as, for example, one or more mechanical locks that engage and secure one or more access doors on a cabinet of the EGMs. Traditionally, casinos have employed cylindrical or barrel locks for this purpose. For instance, many casinos depend upon a barrel lock coupled between an EGM cabinet and an access door to prevent unauthorized entry into the EGM. Thus, traditional locking mechanisms are purely mechanical and cannot be electronically actuated. In addition, there are many hundreds or thousands of types of barrel locks in use across casinos world-wide and casinos are typically reluctant to swap these locks for new or upgraded locking mechanisms, particularly as their employees and technicians would also require replacement keys, etc.

Improvements to electronic gaming machine cabinet locking mechanisms are, however, desirable. For example, locking mechanisms that do not include a requirement of physical contact between a lock and an access door are desirable. In addition, locking mechanisms capable of electronic and/or computer control are desirable. Further, a universal locking mechanism, such as a universal switch assembly, that can be swapped into an existing gaming machine cabinet and used with an existing barrel lock and key combination is desirable.

BRIEF DESCRIPTION

In one aspect, an electronic gaming machine is provided. The electronic gaming machine includes a cabinet, an access door, a hook fixedly coupled to one of i) the cabinet and ii) the access door, an electromechanical latch fixedly coupled to one of the other of i) the cabinet and ii) the access door, wherein the electromechanical latch is configured to releasably engage the hook to lock the access door in a closed position, or disengage the hook to unlock the access door so the access door is moveable to an open position, and a switch assembly operable to control the electromechanical latch. The switch assembly includes a lock coupled to the cabinet and partially extending into the cabinet, a cam coupled to a rotatable portion of the lock located within the cabinet, and a switching element mounted within the cabinet proximate the cam and configured to be mechanically engaged and actuated by the cam when the cam is rotated into contact with the switching element, wherein the switching element is electrically connected to the electromechanical latch and is further configured to control the electromechanical latch in response to actuation by the cam.

In another aspect, a switch assembly for controlling an electromechanical latch of an electronic gaming machine is provided. The switch assembly includes a mechanical lock configured to be coupled to a cabinet of the electronic gaming machine, wherein the mechanical lock includes a keyway configured to receive a key and a rotatable portion, and wherein the keyway is configured to be accessible from an exterior surface of the cabinet, and wherein the rotatable portion is configured to extend at least partially into an interior of the cabinet. The switch assembly also includes a cam coupled to the rotatable portion of the lock, and a switching element configured to be mounted within the cabinet proximate the cam, wherein, during operation, the cam is configured to rotate into contact with the switching element to mechanically engage and actuate the switching element, and wherein, when actuated, the switching element controls the electromechanical latch.

In yet another aspect, a system for controlling access to an electronic gaming machine cabinet is provided. The system includes an electromechanical latch configured to releasably couple an access door to the cabinet, and a switch assembly operable to control the electromechanical latch. The switch assembly includes a lock configured to be coupled to the cabinet, a cam coupled to a rotatable portion of the lock, and a switching element configured to be mounted within the cabinet proximate the cam, wherein the switching element is further configured to be mechanically engaged and actuated by the cam when the cam is rotated into contact with the switching element, and wherein the switching element is further configured to control the electromechanical latch in response to actuation by the cam.

BRIEF DESCRIPTION OF THE DRAWINGS

An example embodiment of the subject matter disclosed will now be described with reference to the accompanying drawings.

DETAILED DESCRIPTION

A switch assembly for controlling a latch of an electronic gaming machine cabinet is described. The switch assembly may include a switching element and a mechanical lock, each mounted on a custom mounting bracket and separated from one another by a small distance. A custom designed cam may be mechanically coupled to a rotatable portion of the lock and may rotate, when the lock is unlocked and turned, with the rotatable portion of the lock into and out of contact with the switching element to actuate the switching element. When the switching element is actuated, a control signal, such as a voltage or current, may be provided to the latch, which may be disposed at any suitable location within the gaming machine cabinet. In response to receiving the control signal, the latch may open and/or close to unlock and/or lock, respectively, an access door on the gaming machine cabinet.

Figure 1:
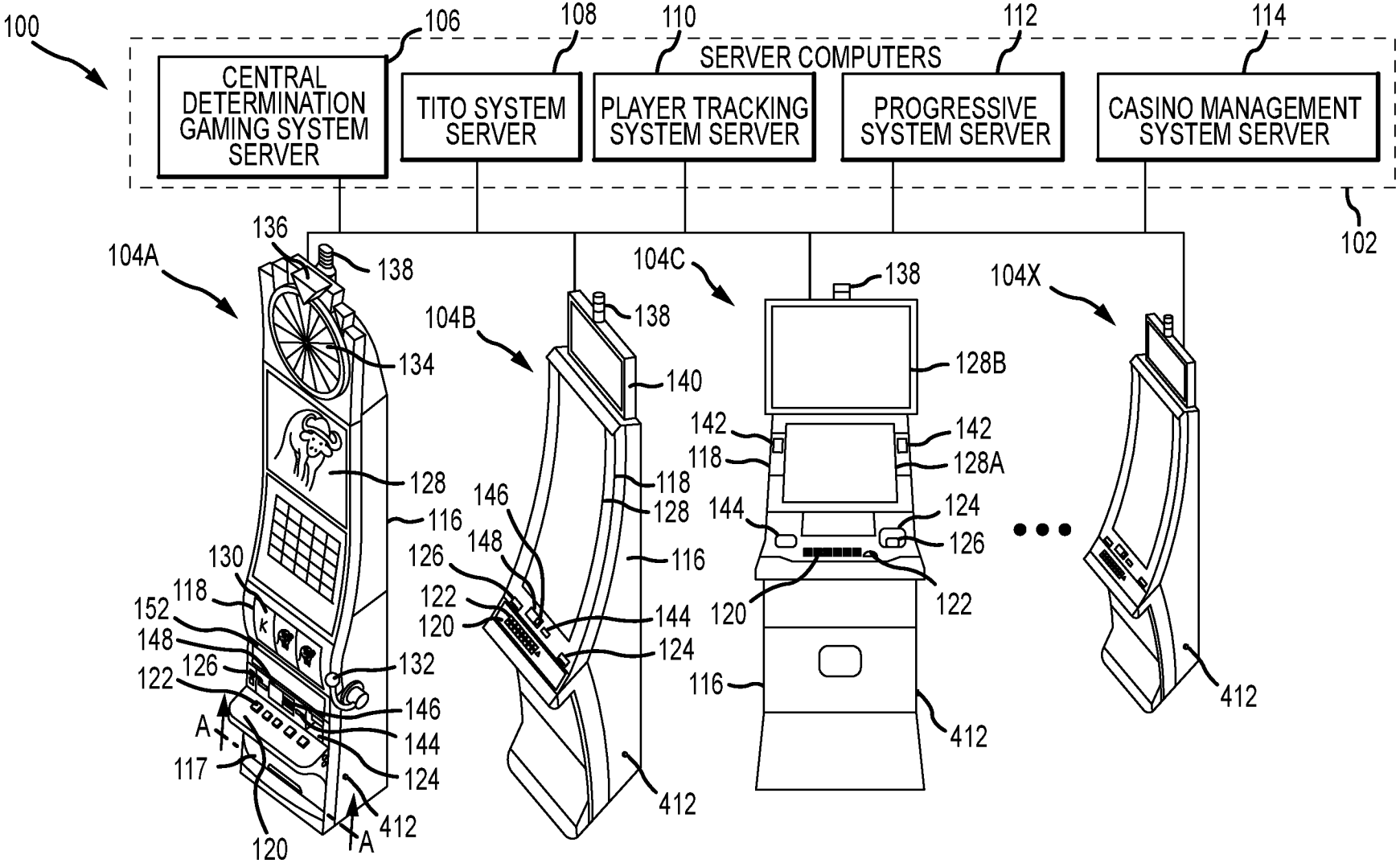
FIG. 1 is a diagram of exemplary EGMs networked with various gaming-related servers.

FIG. 1 is a diagram of exemplary EGMs networked with various gaming-related servers in a gaming system 100. Gaming system 100 operates in a gaming environment, including one or more servers, or server computers, such as slot servers of a casino, that are in communication, via a communications network, with one or more EGMs, or gaming devices 104A-104X, such as EGMs, slot machines, video poker machines, or bingo machines, for example. Gaming devices 104A-104X may, in the alternative, be portable and/or remote gaming devices such as, for example, and without limitation, a smart phone, a tablet, a laptop, or a game console.

Communication between gaming devices 104A-104X and servers 102, and among gaming devices 104A-104X, may be direct or indirect, such as over the Internet through a web site maintained by a computer on a remote server or over an online data network including commercial online service providers, Internet service providers, private networks, and the like. In other embodiments, gaming devices 104A-104X communicate with one another and/or servers 102 over wired or wireless RF or satellite connections and the like.

In certain embodiments, servers 102 may not be necessary and/or preferred. For example, the present invention may, in one or more embodiments, be practiced on a stand-alone gaming device such as gaming device 104A and/or gaming device 104A in communication with only one or more other gaming devices 104B-104X (i.e., without servers 102).

Servers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, a game outcome may be generated on a central determination gaming system server 106 and then transmitted over the network to any of a group of remote terminals or remote gaming devices 104A-104X that utilize the game outcome and display the result to the player.

Gaming device 104A is often of a cabinet construction that may be aligned in rows or banks of similar devices for placement and operation on a casino floor. The gaming device 104A often includes a main door 117 that provides access to the interior of the cabinet. Gaming device 104A typically includes a button area or button deck 120 accessible by a player that is configured with input switches or buttons 122, a bill validator 124, and/or ticket-out printer 126. In some embodiments, and as described below, button deck 120 also functions as (and may be referred to herein) as an access door 120.

In FIG. 1, gaming device 104A is shown as a Relm XL™ model gaming device manufactured by Aristocrat® Technologies, Inc. As shown, gaming device 104A is a reel machine having a gaming display area 118 including a plurality of mechanical reels 130, typically 3 or 5 mechanical reels, with various symbols displayed there on. Reels 130 are then independently spun and stopped to show a set of symbols within the gaming display area 118 that may be used to determine an outcome to the game.

In many configurations, gaming machine 104A may have a main display 128 (e.g., video display monitor) mounted to, or above, gaming display area 118. Main display 128 may be, for example, a high-resolution LCD, plasma, LED, or OLED panel that may be flat or curved as shown, a cathode ray tube, or other conventional electronically controlled video monitor.

In certain embodiments, bill validator 124 may also function as a "ticket-in" reader that enables the player to use a casino-issued credit ticket to load credits onto gaming device 104A (e.g., in a cashless TITO system). In such cashless embodiments, gaming device 104A may also include a "ticket-out" printer 126 for outputting a credit ticket when a "cash out" button is pressed. Cashless ticket systems are well known in the art and are used to generate and track unique bar-codes printed on tickets to allow players to avoid the use of bills and coins by loading credits using a ticket reader and cashing out credits using ticket-out printer 126 on gaming device 104A.

In certain embodiments, a player tracking card reader 144, a transceiver for wireless communication with a player's smartphone, a keypad 146, and/or an illuminated display 148 for reading, receiving, entering, and/or displaying player tracking information can be provided. In such embodiments, a game controller within gaming device 104A communicates with player tracking server system 110 to send and receive player tracking information.

Gaming device 104A may also include, in certain embodiments, a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but could also be incorporated into play of the base game, or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

In certain embodiments, there may also be one or more information panels 152 that may be, for example, a back-lit silkscreened glass panel with lettering to indicate general game information including, for example, a game denomination (e.g., $0.25 or $1), pay lines, pay tables, and/or various game related graphics. In some embodiments, information panels 152 may be implemented as an additional video display.

Gaming device 104A traditionally includes a handle 132 typically mounted to the side of main cabinet 116 that may be used to initiate game play.

Figure 2:
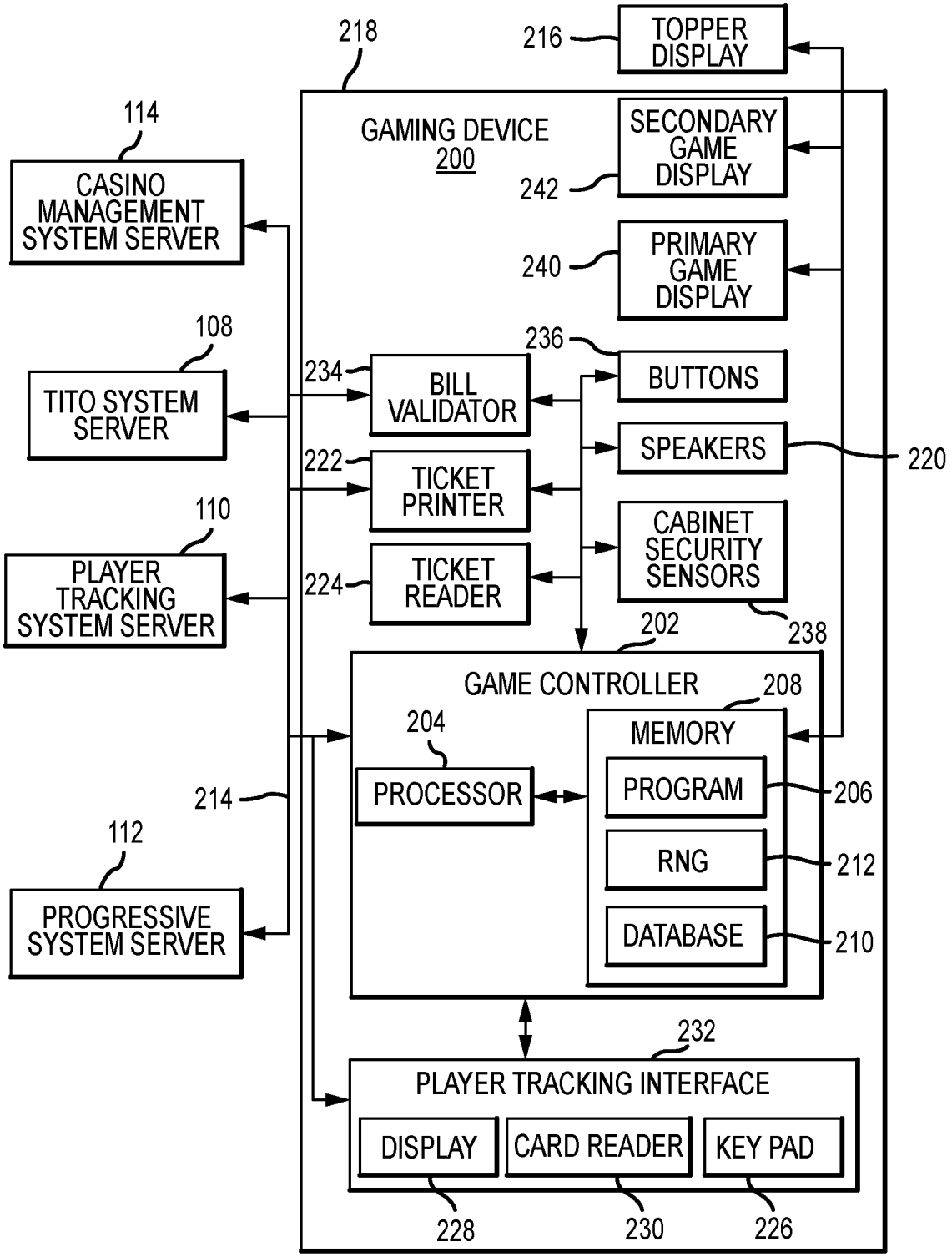
FIG. 2 is a block diagram of an exemplary EGM.

Many or all of the above described components may be controlled by circuitry (e.g., a gaming controller) housed inside main cabinet 116 of gaming device 104A, the details of which are shown in FIG. 2.

Not all gaming devices suitable for implementing embodiments of the gaming systems, gaming devices, or methods described herein necessarily include top wheels, top boxes, information panels, cashless ticket systems, and/or player tracking systems. Further, some suitable gaming devices have only a single game display that includes only a mechanical set of reels and/or a video display, while others are designed, for example, for bar tables or table tops and have displays that face upwards.

Exemplary gaming device 104B shown in FIG. 1 is an Arc™ model gaming device manufactured by Aristocrat® Technologies, Inc. Where possible, reference numeral identifying similar features of gaming device 104A are also identified in gaming device 104B using the same reference numerals. Gaming device 104B, however, does not include physical reels 130 and instead shows game play and related game play functions on main display 128. An optional topper screen 140 may be included as a secondary game display for bonus play, to show game features or attraction activities while the game is not in play, or any other information or media desired by the game designer or operator. In some embodiments, topper screen 140 may also or alternatively be used to display progressive jackpot prizes available to a player during play of gaming device 104B.

Gaming device 104B includes main cabinet 116 having main door 118 that opens to provide access to the interior of gaming device 104B. Main door 118, or service door, is typically used by service personnel to refill ticket-out printer 126 and collect bills and tickets inserted into bill validator 124. Main door 118 may further be accessed to reset the machine, verify and/or upgrade the software, and for general maintenance operations.

Exemplary gaming device 104C shown in FIG. 1 is a Helix™ model gaming device manufactured by Aristocrat® Technologies, Inc. Gaming device 104C includes a main display 128A that is in a landscape orientation. Although not illustrated by the front view illustrated in FIG. 1, landscape display 128A has a curvature radius from top to bottom. In certain embodiments, display 128A is a flat panel display. Main display 128A is typically used for primary game play while a secondary display 128B is used for bonus game play, to show game features or attraction activities while the game is not in play, or any other information or media desired by the game designer or operator.

Many different types of games, including mechanical slot games, video slot games, video poker, video black jack, video pachinko, keno, bingo, and lottery, may be provided with or implemented within gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, Class II, or Class III, etc.

FIG. 2 is a block diagram of an exemplary gaming device 200, or EGM, connected to various external systems, including TITO system server 108, player tracking system server 110, progressive system server 112, and casino management system server 114. All or parts of gaming device 200 may be embodied in game devices 104A-104X shown in FIG. 1. The games conducted on gaming device 200 are controlled by a game controller 202 that includes one or more processors 204 and a memory 208 coupled thereto. Games are represented by game software or a game program 206 stored on memory 208. Memory 208 includes one or more mass storage devices or media housed within gaming device 200. One or more databases 210 may be included in one or more databases 210 for use by game program 206. A random number generator (RNG) 212 is implemented in hardware and/or software and is used, in certain embodiments, to generate random numbers for use in operation of gaming device 200 to conduct game play and to ensure the game play outcomes are random and meet regulations for a game of chance.

Alternatively, a game instance, or round of play of the game, may be generated on a remote gaming device such as central determination gaming system server 106, shown in FIG. 1. The game instance is communicated to gaming device 200 via a network 214 and is then displayed on gaming device 200. Gaming device 200 executes game software to enable the game to be displayed on gaming device 200. In certain embodiments, game controller 202 executes video streaming software that enables the game to be displayed on gaming device 200. Game software may be loaded from memory 208, including, for example, a read only memory (ROM), or from central determination gaming system server 106 into memory 208. Memory 208 includes at least one section of ROM, random access memory (RAM), or other form of storage media that stores instructions for execution by processor 204.

Gaming device 200 includes a topper display 216. In an alternative embodiment, gaming device 200 includes another form of a top box such as, for example, a topper wheel, or other topper display that sits on top of main cabinet 218. Main cabinet 218 or topper display 216 may also house various other components that may be used to add features to a game being played on gaming device 200, including speakers 220, a ticket printer 222 that prints bar-coded tickets, a ticket reader 224 that reads bar-coded tickets, and a player tracking interface 232*a*. Player tracking interface 232*a* may include a keypad 226 for entering player tracking information, a player tracking display 228 for displaying player tracking information (e.g., an illuminated or video display), a card reader 230 for receiving data and/or communicating information to and from media or a device such as a smart phone enabling player tracking. Ticket printer 222 may be used to print tickets for TITO system server 108. Gaming device 200 may further include a bill validator 234, buttons 236 for player input, cabinet security sensors 238 to detect unauthorized opening of main cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered and time of play) for individual players so that an operator may reward players in a loyalty program. The player may use player tracking interface 232*a* to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by casino management system server 114.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because (1) regulatory requirements for gaming devices, (2) harsh environments in which gaming devices operate, (3) security requirements, and (4) fault tolerance requirements. These differences require substantial engineering effort and often additional hardware.

When a player wishes to play gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances of the game. The credit balance is decreased by the amount of each wager and increased upon a win. The player can add additional credits to the balance at any time. The player may also optionally insert a loyalty club card into card reader 230. During the game, the player views the game outcome on game displays 240 and 242. Other game and prize information may also be displayed.

For each game instance, a player may make selections that may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using player-input buttons 236, primary game display 240, which may include a touch screen, or using another suitable device that enables a player to input information into gaming device 200.

During certain game events, gaming device 200 may display visual and auditory effects that can be perceived by the player. These effects add to the excitement of a game, which makes a player more likely to continue playing. Auditory effects include various sounds that are projected by speakers 220. Visual effects include flashing lights, strobing lights, or other patterns displayed from lights on gaming device 200 or from lights behind information panel 152, shown in FIG. 1.

When the player wishes to stop playing, he/she cashes out the credit balance (typically by pressing a cash out button to receive a ticket from ticket printer 222). The ticket may be "cashed-in" for money or inserted into another machine to establish a credit balance for play.

Figure 3:
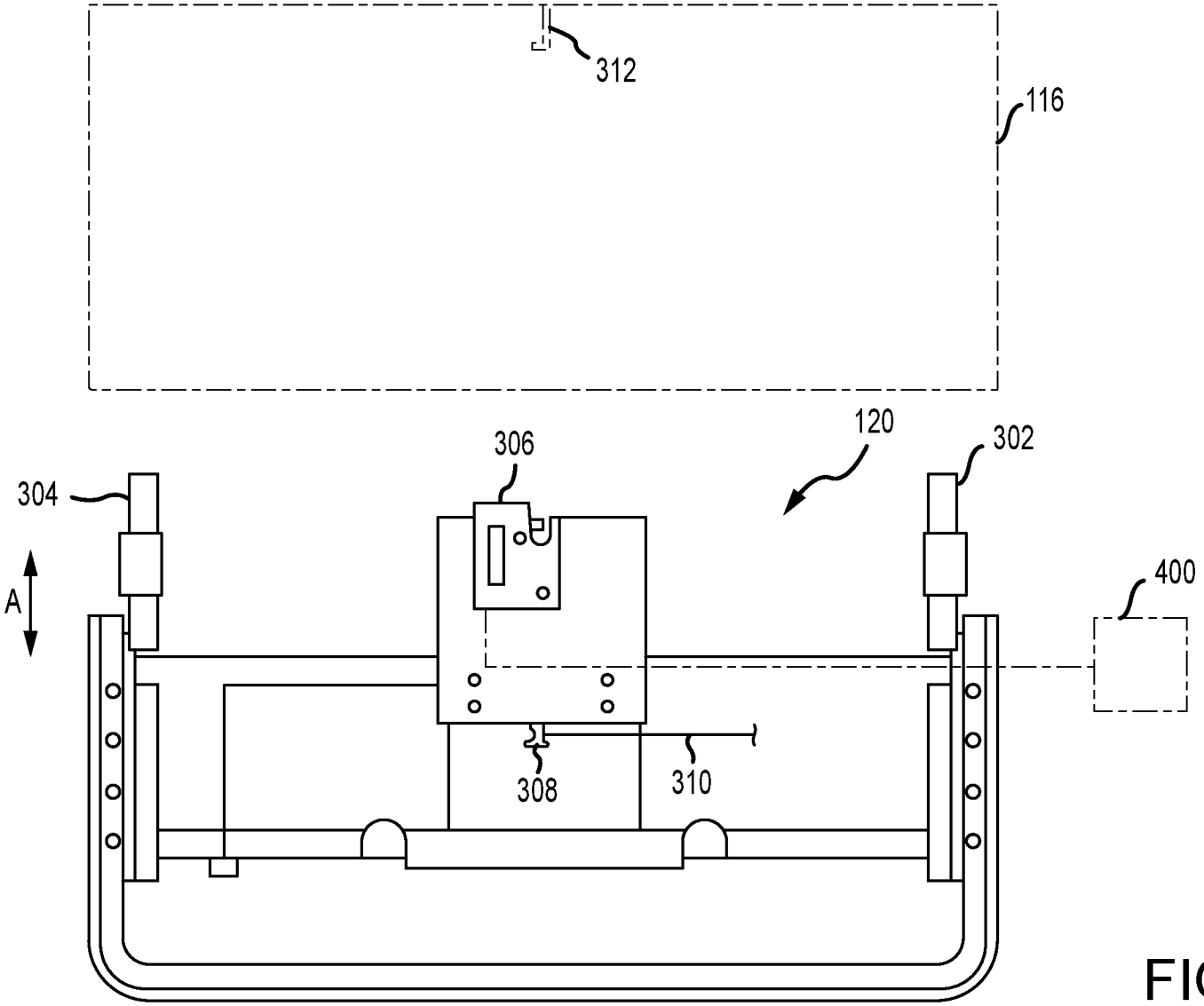
FIG. 3 is a bottom view taken along the line A-A of an exemplary access door of an EGM shown in FIG. 1, in which the access door is lockable and unlockable from a main cabinet of the EGM, as described in association with various embodiments.

FIG. 3 is a bottom view taken along the line A-A in FIG. 1 of an exemplary access door 120 of an EGM 104A-104X, in which access door 120 is lockable in a closed position and unlockable to an open position from a cabinet of the EGM 104A-104X, such as main cabinet 116. In the example shown, access door 120 is a button deck of an EGM 104A-104X (as described above). However, access door 120 may be any access door and/or any other lockable and/or unlockable component of an EGM 104A-104X, such as, for example, main door 117, and/or any other display, sign, slot stand, player input interface, credit input mechanism, and the like. Accordingly, a button deck is merely one illustrative embodiment of an access door that may be locked, unlocked, and/or controlled using the systems and methods described herein.

In the exemplary embodiment, access door 120 may be slidably mounted on a plurality of drawer slide assemblies, such as a first drawer slide assembly 302 and a second drawer slide assembly 304. During operation, access door 120 may be moved on drawer slide assemblies 302-304 relative to main cabinet 116 and away from main cabinet 116, as shown in the direction of arrow A, to selectively extend or retract access door 120 relative to main cabinet 116. For instance, in the retracted or closed position, access door 120 is positioned for game play, while in the extended or open position, access door 120 is moved away from main cabinet 116 creating a space to access an interior of main cabinet 116, such as, for example, for service of elements like bill validator 234, ticket printer 222, ticket reader 224, and/or any other internal or interior mounted component (see, e.g., FIG. 2).

Additional detail related to the operation and motion of access door 120 on drawer slide assemblies 302-304 is not central to an understanding of the present disclosure. However, such detail may be obtained with reference to U.S. patent application Ser. No. 15/922,236, filed Mar. 15, 2018 and entitled, GAMING MACHINE WITH SLIDE-OUT BUTTON DECK ASSEMBLY AND MANUALLY OPERABLE PUSH-TO-RELEASE LATCH MECHANISM, which is hereby incorporated by reference in its entirety.

For security, access door 120 may be lockable on and unlockable from main cabinet 116 by a latch 306, which may be mechanically coupled to or otherwise incorporated in main cabinet 116 and/or access door 120. For example, latch 306 may be attached to main cabinet 116 and operable to receive and engage a portion of access door 120, such as a hook or tab (not shown) built into access door 120, to lock access door 120 on main cabinet 116. Conversely, latch 306 may be attached to access door 120 (as shown in the embodiment of FIG. 3) an operable to receive and engage a portion of cabinet 116, such as hook or tab 312 built into cabinet 116, to lock access door 120 on main cabinet 116. In either case, latch 306 may be operable to release the hook or tab (e.g., hook 312) to unlock and decouple access door 120 from main cabinet 116, such that access door 120 may be extended or drawn from a closed position in which access door 120 is locked on and secured to cabinet 116 to an open position in which access door 120 is extended or drawn away from cabinet 116, thereby providing access to an interior of cabinet 116.

To this end, in the exemplary embodiment, latch 306 may comprise an electromechanical latch, such as an electromechanical rotary latch. In some embodiments, latch 306 is an electromechanical rotary latch available from SOUTHCO (https://www.southco.com/en-us/), although other latch elements, such as other electrically actuable latches, are possible. With such an electronic rotary latch, latch 306 may be released or actuated in an automatic manner via a control signal from the game controller 202 or by another control element. Moreover, as described below, latch 306 may be released or actuated in an automatic manner via a control signal from a switch or switching element electrically coupled to latch 306. Latch 306 may also include a manual actuation mechanism, such as a latch release 308, which may be used to open latch 306 in the event of power loss, or at another time as desired, as a mechanical over-ride. For example, a pull cable 310 may, in some embodiments, be attached to latch release 308 and used to manually actuate latch release 308.

In various embodiments, latch 306 may include one or more intrusion detection mechanisms. For example, in some embodiments, latch 306 may include an internal magnetic proximity switch capable of detecting whether latch 306 is open or closed (e.g., engaged or disengaged with access door 120). Similarly, latch 306 may include an internal electronic switch capable making the same determination. Thus, in at least some embodiments, latch 306 includes a redundant intrusion detection mechanism that includes an internal magnetic proximity switch and an electronic switch. Each of these internal switches may be configured to provide a signal, such as a voltage or current, to a computer processor of the system, such as a processor of game controller 202 (e.g., processor 404 below). Moreover, in some embodiments, game controller 202 may communicate the information provided by one or more intrusion detection switches internal to latch 306 to one or more other backend systems, such as player tracking system server 110. Thus, in some embodiments, a backend system, such as player tracking system server 110 may store a record of unauthorized (and/or authorized) cabinet access attempts, and the like.

Thus, latch 306 may be attached to main cabinet 116 and/or access door 120 and arranged to receive and engage the other of access door 120 or main cabinet 116 to lock or secure the access door 120 to main cabinet 116. In addition, latch 306 may be configured to release or disengage access door 120 and/or main cabinet 116, so that access door 120 is unlocked from main cabinet 116. Once unlocked, access door 120 may be drawn away or opened from main cabinet 116 to provide access to a variety of internal components, such as, for example, bill validator 234, ticket printer 222, ticket reader 224, and/or any other internal or interior mounted component. In one example, including the example shown at FIG. 3, access door 120 is a button deck that is slidably mounted on a pair of drawer slide assemblies 302-304. In this embodiment, the button deck may be locked on and unlocked from main cabinet 116 by latch 306 and slidably extended and retracted relative to main cabinet 116 to give access to the components secured within main cabinet 116.

Further, latch 306 may, in various embodiments, be any of a variety of suitable latches. For example, in at least one embodiment, latch 306 may be an electromechanical rotary latch. To actuate latch 306, a processor, such as game controller 202, may provide a control signal, which may cause latch 306 to lock and/or unlock. Similarly, and as described in detail below, a switch assembly may be electrically coupled to latch 306, and the switch assembly may, instead or in addition to game controller 202, provide a control signal to latch 306 that causes latch 306 to lock and unlock. In some embodiments, latch 306 includes a mechanical latch release 308, which may be mechanically coupled to pull cable 310. A user may apply tension on pull cable 310 to mechanically actuate latch 306 via latch lease 308. Thus, latch 306 may be actuated in any of a variety of ways.

Figure 4:
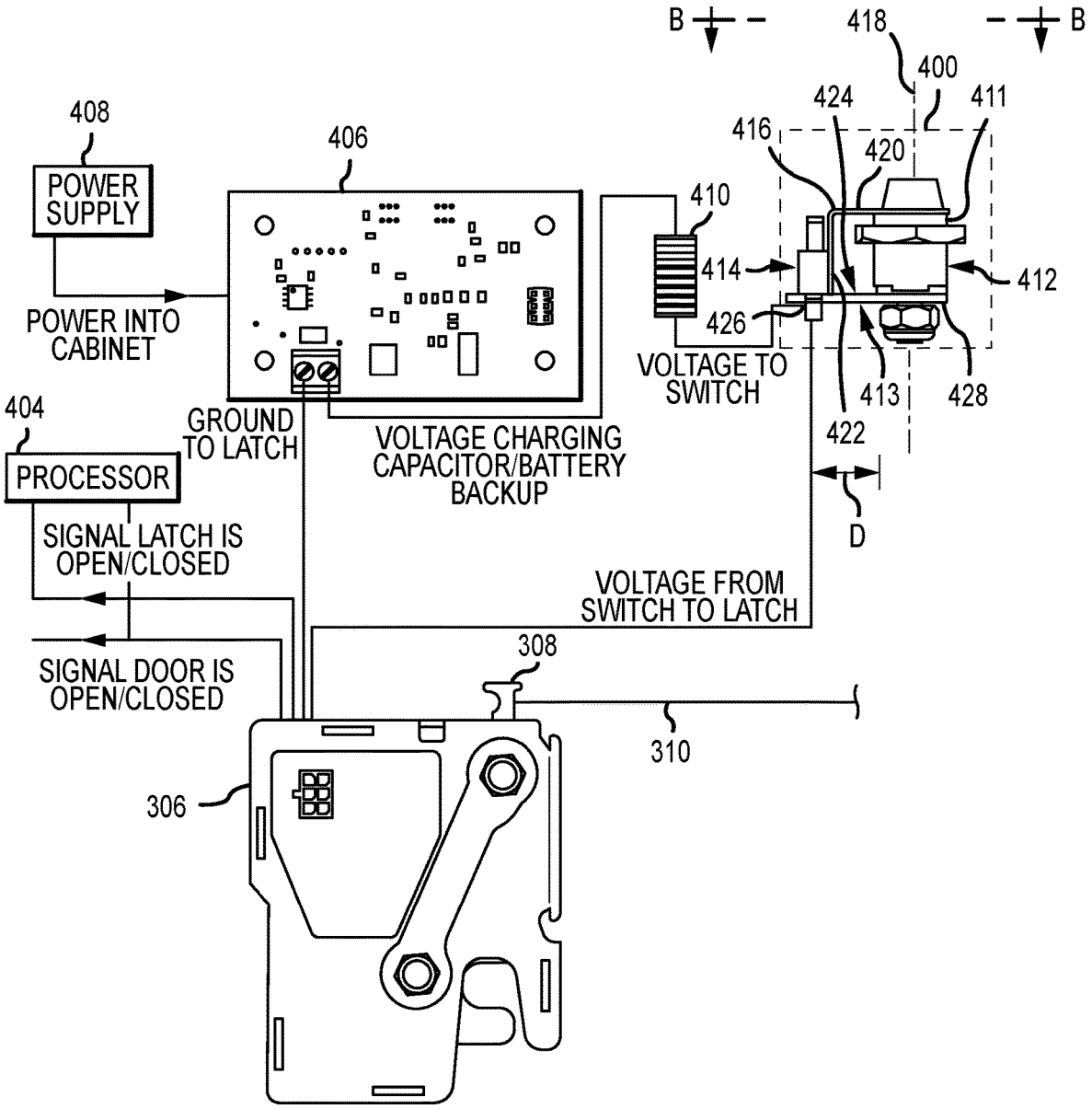
FIG. 4 is a schematic diagram of an exemplary switch assembly and latch for locking and unlocking the access door shown in FIG. 3, as described in association with various embodiments.

FIG. 4 is a schematic diagram of an exemplary switch assembly 400 and latch 306 for locking and unlocking access door 120 (shown in FIG. 3). Specifically, FIG. 4 illustrates the components necessary to actuate latch 306 in any of the manners described more briefly above, such as, for example, via a processor of game controller 202, via a signal received from switch assembly 400, and/or manually via latch release 308 and pull cable 310. To this end, and in the exemplary embodiment, latch 306 may be electrically and/or communicatively coupled to switch assembly 400. Likewise, latch 306 may be electrically and/or communicatively coupled to a processor 404, such as processor 204 of game controller 202, and/or any other suitable computer processor. In addition, latch 306 may be electrically coupled to and grounded through a printed circuit board (PCB) 406, such as, for example, a power supply board. In the exemplary embodiment, a power supply 408, such as a switched mode power supply, may be electrically coupled to PCB 406 and may, as shown, supply electrical power to latch 306 and/or switch assembly 400 through PCB 406.

Although various components are illustrated in FIG. 4 as being physically interconnected by a plurality of electrical wires, in some embodiments, one or more components may be configured to communicate wirelessly. For example, in some embodiments, switch assembly 400 may wirelessly communicate with latch 306 and/or processor 404, such as via any wireless communication protocol or standard, including, without limitation, an RFID communication protocol, a WIFI communication protocol, a BLUETOOTH communication protocol, and the like. To this end, any of the components described herein may be wirelessly enabled and may include wireless communication hardware and/or functionality. For example, switch assembly 400, latch 306, and/or processor 404 may include one or more RFID, WIFI, and/or BLUETOOTH components, such as one or more transmitters and/or receivers, and/or any other suitable wireless communication functionality. Similarly, and in various embodiments, any of the other components described herein may wirelessly communicate.

In the exemplary embodiment, an energy storage device 410, such as a capacitor and/or battery backup, may be electrically coupled between PCB 306 and switch assembly 400. Specifically, energy storage device 410 may receive electrical power, via PCB 306, from power supply 408. In the event that electrical power is interrupted from power supply 408, energy storage device 410 may be operable to temporarily supply electrical power to switch assembly 400 and/or latch 306, such as for a time period ranging from several hours to many days. Thus, in at least some embodiments, switch assembly 400 and/or latch 306 may be protected from electrical power failure, such that main cabinet 116 remains locked when electrical power is interrupted to switch assembly 400 and/or latch 306.

Switch assembly 400 may include several components. Specifically, switch assembly 400 may include a mechanical lock 412, a custom mounting bracket 413, and a switching element 414, such as a micro-switch or, more commonly, a snap-action switch. Those of skill will appreciate that there are numerous snap-action switches commercially available.

Lock 412 may include any suitable mechanical lock, such as, for example, any suitable cylindrical or barrel lock. As described above, many casinos employ a specific lock or a specific type of lock casino-wide. Thus, in various embodiments, lock 412 is any cylindrical or barrel lock commonly used by a casino to lock an access door, such as access door 120, on a gaming machine cabinet, such as main cabinet 116.

As a result, lock 412 may include a keyhole and/or keyway 502 (see FIG. 5) configured to receive a key and a rotatable portion 411. A cam 416 may be mechanically coupled to rotatable portion 411 and arranged to rotate with rotatable portion 411. More particularly, during operation, a key may be inserted and rotated or turned in keyway 502 of lock 412 to unlock lock 412. It will be appreciated that once lock 412 is unlocked by the key, rotatable portion 411 may become free to rotate about an axis 418 of lock 412. Further, as rotatable portion 411 rotates about axis 418, cam 416 may rotate with rotatable portion 411, also about the axis 418.

In the exemplary embodiment, cam 416 may be L-shaped and may include a first elongated portion 420 and a second elongated portion 422, which may meet or join first elongated portion 420 at a ninety degree angle to create an L-shape, as shown. In various embodiments, cam 416 is a custom designed component and is shaped to engage a lever or actuator (not shown) of switching element 414, as described herein. Further, although cam 416 is L-shaped in the illustrated example, it will be appreciated that cam 416 may include any suitable shape capable of engaging and actuating switching element 414.

In addition, cam 416 may include an aperture or hole (not shown) adapted to engage or mount on rotatable portion 411 of lock 412. Specifically, first elongated portion 420 of cam 416 may be adapted to attach to a variety of cylindrical or barrel locks commonly used by casinos. In this manner, casinos may install and utilize the systems and methods described herein without having to replace or swap out the locks 412 already in use. Rather, any casino wishing to add the systems and methods described herein to an existing cabinet and access door may simply swap or replace an existing cam with cam 416, which, again, is customized or custom-shaped to interface with, engage, and actuate switching element 414.

In the exemplary embodiment, custom mounting bracket 413 may include any suitable elongated structural member adapted or configured to receive and secure lock 412 and switching element 414 thereon. For example, custom mounting bracket 413 may comprise an elongated, substantially planar, structural member having a receiving surface 424. A first aperture 426 and a second aperture 428 may be formed, machined, or otherwise included in receiving surface 424. In addition, first aperture 426 may be configured to receive and secure switching element 414, such that switching element 414 extends orthogonally away from receiving surface 424. Likewise, second aperture 428 may be configured to receive and secure lock 412, such that lock 412 extends orthogonally away from receiving surface 424.

Figure 5B:
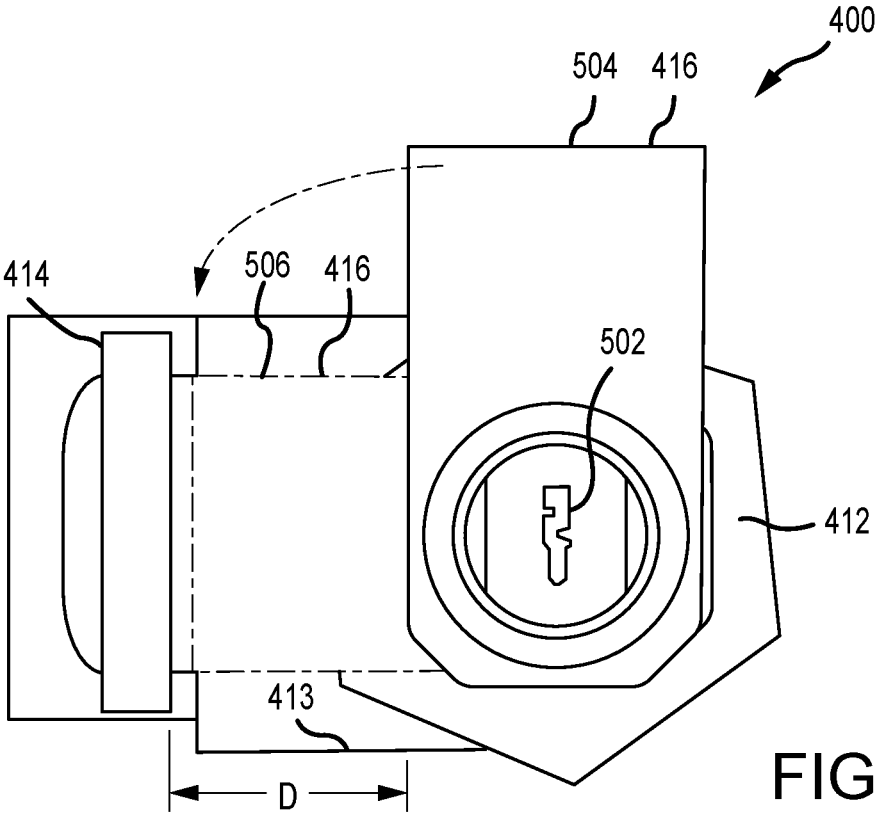
FIG. 5B is a top view taken along the line B-B of the switch assembly shown in FIG. 4, in which a cam of the switch assembly is shown in a closed position.
Figure 5A:
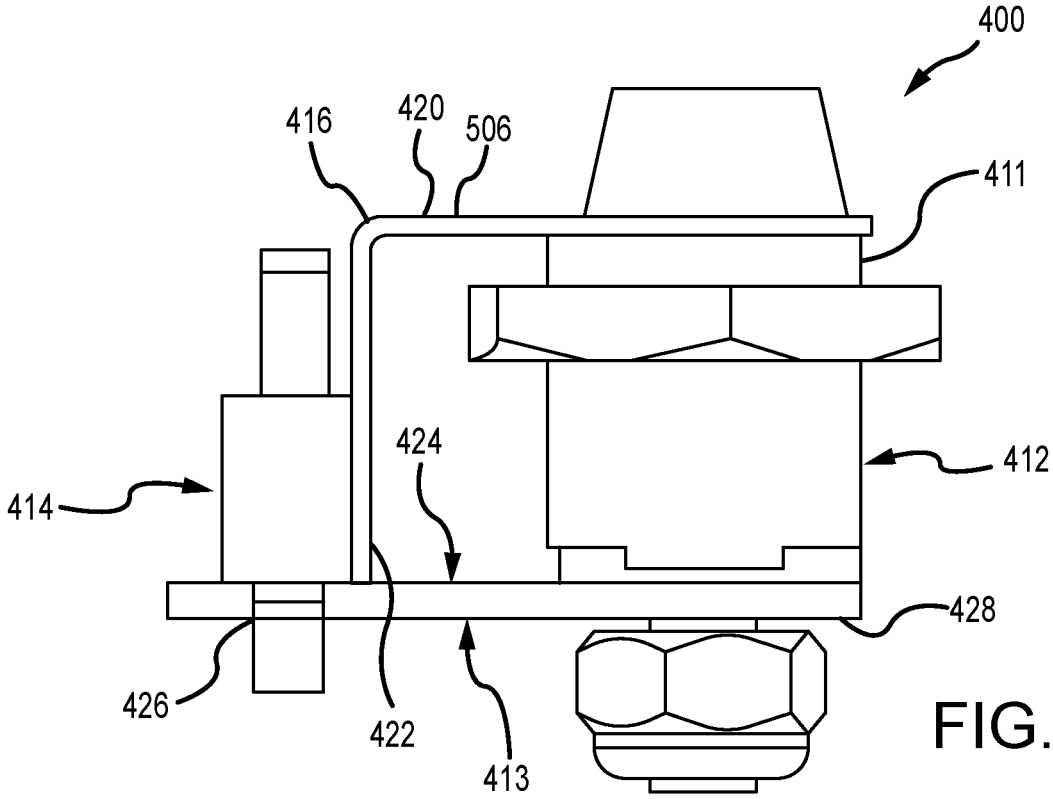
FIG. 5A is a side view of the switch assembly shown in FIG. 4, in which a cam of the switch assembly is shown in an open position and a closed position.

FIG. 5A is a side view of switch assembly 400 (shown in FIG. 4), in which cam 416 is shown in an open position 504 and a closed position 506. FIG. 5B is a top view of switch assembly 400 taken along the line B-B (shown in FIG. 4), in which cam 416 is shown in closed position 506. Accordingly, and with combined reference to FIGS. 5A and 5B, switching element 414 and lock 412 may extend away from receiving surface 424 substantially parallel to one another and separated by a distance, D. For example, as shown, when cam 416 rotates from open position 504 to closed position 506 on rotatable portion 411 of lock 412, second elongated portion 422 of cam 416 may rotate into contact with switching element 414 to actuate switching element 414. Specifically, second elongated portion 422 of cam 416 may rotate into contact with and depress or trigger a lever or mechanical actuator of switching element 414. Similarly, cam 416 may rotate in a reverse direction, from closed position 506 to open position 504, on rotatable portion 411 of lock 412 to break physical contact with and disengage switching element 414. Thus, lock 412 and switching element 414 are physically situated on custom mounting bracket 413 in a way that allows cam 416 of lock 416 to rotate, between open position 504 and closed position 506, into and out of contact with switching element 414.

In the exemplary embodiment, latch 306, switch assembly 400, processor 404, PCB 406, power supply 408, and/or energy storage device 410 may be securely housed within main cabinet 116. For example, as described above, latch 306 may be housed within main cabinet 116 and operable to engage and disengage an access door, such as access door 120, to lock and unlock the access to on main cabinet 116.

More particularly, in the exemplary embodiment, lock 412 may extend between an exterior surface of main cabinet 116 and an interior of main cabinet 116, such that the keyway 502 of lock 412 is accessible from outside main cabinet and such that, at least cam 416 is housed within main cabinet 116. In addition, custom mounting bracket 413 may be mounted or attached at any suitable location within main cabinet 116, such as, for example in a location that accommodates easy or convenient access to the keyway 502 of lock 412 from an exterior surface of main cabinet 412.

Accordingly, in some embodiments, switch assembly 400 may be mechanically coupled or attached to a surface of main cabinet 116, such as an interior surface of main cabinet 116, and electrically connected (e.g., via an electrical wire or cable) to latch 306, which may be disposed in a physical location separate from the physical location of switch assembly 400. In other words, it is not necessary that switch assembly 400 be located physically proximate latch 306; however, in some embodiments, switch assembly 400 may be disposed physically proximate latch 306. For example, in some embodiments, switch assembly 400 may be mechanically coupled to or attached to access door 120.

Notably, lock 412, mounting bracket 413, and switching element 414 may be mounted at any location proximate to or apart from latch 306. Specifically, in at least some embodiments, it is not necessary that latch 306 be physically proximate lock 412, mounting bracket 413, and switching element 414. Rather, an electrical wire (or wires) of any suitable length may connect switching element 414 to latch 306, such that latch 306 is operable to engage and disengage access door 120, irrespective of the proximity or distance of access door 120 from lock 412.

Therefore, in operation, a user, such as a casino technician and/or another individual in possession of a key associated with lock 412, may insert the key in the keyway 502 of lock 412 and rotate the key therein to lock and/or unlock the lock 412. Lock 412 may not, however, lock or mechanically couple access door 120 to main cabinet 116. Rather, latch 306 may, as described above, function to mechanically couple or lock access door 120 to main cabinet 116. Thus, although insertion of a key in lock 412 may, as described below, function to accomplish disengagement or unlocking of access door 120 from main cabinet 116, the process by which this occurs is not merely physical unlocking of lock 412 to free access door 120.

Rather, in the case that lock 412 is locked and a key is inserted in its keyway 502, the key may be rotated or turned in the keyway 502, as is common with many mechanical locks, to release the internal locking mechanism within lock 412. Once unlocked, rotatable portion 411 of lock 412 may be rotated, such as in unison with the key as it rotates within the keyway 502. Likewise, as rotatable portion 411 rotates, cam 416 may rotate, such as about the lock axis 418, in unison with rotatable portion 411.

As described above, cam 416 is L-shaped and includes a second elongated portion 422 that rotates into contact with, and actuates, switching element 414 as cam 416 turns with rotatable portion 411 of lock 412. Thus, actuation or unlocking of lock 412 causes cam 416 to rotate into contact with switching element 414 (e.g., a lever or another actuator thereof). As cam 416 actuates switching element 414, switching element 414 provides a control signal, such as a small voltage or current, to latch 306. It will be appreciated that if the key is rotated in the opposite direction within lock 412, cam 416 rotates out of contact with switching element 414, and the control signal to latch 306 is interrupted or halted. Moreover, it will be appreciated that switching element 414 may be configured to function in the opposite manner with essentially the same result. Specifically, switching element 414 may be actuated by cam 416 to discontinue a control signal to latch 306, in which case, the control signal may be provided by switching element 414 when it is not actuated by cam 416.

In either case, however, latch 306 may be configured to unlock or disengage access door 120 in response to receipt of a control signal from switching element 414 and/or in response to discontinuation of the control signal (depending upon the configuration used). For instance, in the exemplary embodiment, when the casino technician unlocks lock 412, cam 416 may rotate into contact with switching element 414, which may, in response, provide a control signal to latch 306. When the control signal is received, latch 306 may disengage access door 120, and access door 120 may be opened, such that the casino technician is able to access the interior of main cabinet 116. To lock access door 120 back on main cabinet 116, the technician may simply move access door 120 into a closed position with latch 306 and rotate the key in lock 412 to re-engage latch 306 on access door 120.

In addition to control of latch 306 by switch assembly 400, processor 404 may also be capable of controlling latch 306. For example, processor 404 may also be configured to provide a control signal to latch 306 to open and close latch 306. More particularly, in some embodiments, a casino technician may carry a tablet computing device or smartphone capable of communicating (e.g., wirelessly communicating) with processor 404. The casino technician may provide an instruction, via the tablet computing device or smartphone, to processor 404 to open and/or close latch 306. Thus, in at least some embodiments, a casino technician may lock and unlock and access door 120 even without the use of a physical key to lock 412.

Moreover, processor 404 may be capable of overriding a control signal provided by switch assembly 400, as described above, that would otherwise cause latch 306 to remain locked. In other words, even where cam 416 does not engage and actuate switching element 414 to unlock latch 306, processor 404 may be operable to unlock latch 306. For instance, in one embodiment, switch assembly may provide a first control signal to latch 306 that causes latch 306 to lock. Processor 404 may, however, provide a second control signal to latch 306 that supersedes and overrides the first control signal, causing latch 306 to unlock notwithstanding the first control signal.

Thus, a switch assembly for controlling a latch of an electronic gaming machine cabinet is provided. The switch assembly includes a switching element and a mechanical lock, each mounted on a custom mounting bracket and separated from one another by a small distance. A custom designed cam is mechanically coupled to a rotatable portion of the lock and rotates, when the lock is unlocked and turned, with the rotatable portion of the lock into and out of contact with the switching element to actuate the switching element. When the switching element is actuated, a control signal, such as a voltage or current, is provided to the latch, which may be disposed at any suitable location within the gaming machine cabinet. In response to receiving the control signal, the latch may open and/or close to unlock and/or lock, respectively, an access door on the gaming machine cabinet.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A switch assembly for electronically controlling an electromechanical latch of an electronic gaming machine, the switch assembly comprising:

a mechanical lock comprising one of a plurality of industry-standard mechanical locks, the mechanical lock configured to be coupled to a cabinet of the electronic gaining machine, the mechanical lock including a keyway configured to receive a key and a rotatable portion, the keyway configured to be accessible from an exterior surface of the cabinet, the rotatable portion configured to extend at least partially into an interior of the cabinet;

a customized cam coupled to the rotatable portion of the mechanical lock, the customized cam configured to be coupled to any of the plurality of industry-standard mechanical locks to permit control of the electromechanical latch by any of the plurality of industry-standard mechanical locks; and a switching element configured to be mounted within the cabinet proximate the customized cam, wherein the switching element is in communication with an electromechanical latch configured to mechanically lock or unlock an access door of the cabinet of the electronic gaming machine, wherein:

during operation, the customized cam is configured to rotate on the rotatable portion of the mechanical lock into mechanical contact with the switching element to mechanically engage and actuate the switching element, and when actuated, the switching element generates a first electronic signal to electronically control the electromechanical latch, wherein the electromechanical latch is configured to:

receive the first electronic signal from the switching element;

receive a second electronic signal from the electronic gaming machine; and lock or unlock the access door based on the first electronic signal and the electronic signal.

2. The switch assembly of claim 1, wherein the switching element is further configured to control the electromechanical latch to cause the electromechanical latch to disengage and unlock an access door of the electronic gaming machine in response to actuation by the cam.

3. The switch assembly of claim 1, wherein the switching element is a micro-switch, and wherein the electromechanical latch is an electromechanical rotary latch, and wherein the lock is a cylindrical lock.

4. The switch assembly of claim 1, further comprising a mounting bracket configured to receive the mechanical lock, the mounting bracket further configured to accommodate any of the plurality of industry-standard mechanical locks.

5. The switch assembly of claim 1, wherein the electromechanical latch is configured to unlock the access door when the first electronic signal and the second electronic signal both instruct the electromechanical latch to unlock.

6. The switch assembly of claim 1, wherein at least one of the first electronic signal and the second electronic signal are wireless signals.

7. An electronic gaming machine comprising:

a cabinet;

an access door;

a hook fixedly coupled to one of i) the cabinet and ii) the access door;

an electromechanical latch fixedly coupled to one of the other of i) the cabinet and ii) the access door, wherein the electromechanical latch is configured to mechanically engage the hook to lock the access door in a closed position, or mechanically disengage the hook to unlock the access door so that the access door is moveable to an open position; and a switch assembly operable to control the electromechanical latch, the switch assembly comprising:

a lock comprising one of a plurality of industry-standard locks, the lock coupled to the cabinet and partially extending into the cabinet;

a cam coupled to a rotatable portion of the lock located within the cabinet, the cam configured to be coupled to any of the plurality of industry-standard locks; and a switching element mounted within the cabinet proximate the cam, wherein:

the switching element is configured to be mechanically engaged and actuated by the cam when the cam is rotated on the rotatable portion of the lock into mechanical contact with the switching element, and the switching element is electrically connected to the electromechanical latch and is further configured to generate a first electrical signal to electronically control the electromechanical latch in response to mechanical actuation by the cam, wherein the electromechanical latch is configured to:

receive the first electrical signal from the switching element;

receive a second electrical signal from a processor of the electronic gaming machine; and engage or disengage the hook based on the first electrical signal and the second electrical signal.

8. The electronic gaming machine of claim 7, wherein the switching element is further configured to cause the electromechanical latch to disengage the hook and unlock the access door in response to mechanical actuation by the cam.

9. The electronic gaming machine of claim 7, further comprising a processor, wherein the processor is configured to perform operations comprising receiving, from the electromechanical latch, a signal indicating that the electromechanical latch is at least one of open and closed.

10. The electronic gaming machine of claim 7, further comprising a processor, wherein the processor is configured to perform operations comprising transmitting a signal to the electromechanical latch that causes the electromechanical latch to at least one of engage and disengage the hook.

11. The electronic gaming machine of claim 10, wherein the processor is further configured to perform operations comprising transmitting the signal to the electromechanical latch to allow access to the cabinet independent of operation of the switching element.

12. The electronic gaining machine of claim 7, further comprising a processor, wherein the processor is configured to perform operations comprising overriding the first electrical signal provided by the switching element to the electromechanical latch when the switching element is mechanically engaged and actuated by the cam, such that the access door remains locked.

13. The electronic gaming machine of claim 7, wherein the electromechanical latch is an electromechanical rotary latch.

14. The electronic gaming machine of claim 7, wherein the lock is a barrel lock.

15. The electronic gaming machine of claim 7, wherein the switch assembly further comprises a mounting bracket configured to receive the lock.

16. The electronic gaming machine of claim 15, wherein the mounting bracket is configured to accommodate any of the plurality of industry-standard mechanical locks used by casinos to secure access doors on electronic gaming machine cabinets.

17. The electronic gaming machine of claim 7, wherein the access door is a button deck of the electronic gaming machine.

18. A system for controlling access to an electronic gaming machine cabinet, the system comprising:

an electromechanical latch configured to mechanically couple an access door to the electronic gaming machine cabinet; and a universal switch assembly operable to generate an electronic signal to electronically control the electromechanical latch, the universal switch assembly comprising:

a lock comprising one of a plurality of industry-standard mechanical locks, the lock configured to be mechanically coupled to the cabinet;

a cam coupled to a rotatable portion of the lock, the cam configured to be coupled to any of the plurality of industry-standard mechanical locks to permit interoperation between any of the plurality of industry-standard mechanical locks and the electromechanical latch; and a switching element configured to be mounted within the cabinet proximate the cam, wherein:

the switching element is further configured to be mechanically engaged and actuated by the earn when the cam is rotated on the rotatable portion of the lock into mechanical contact with the switching element, and the switching element further is configured to generate a first electronic control signal to electronically control the electromechanical latch in response to mechanical actuation by the cam, wherein the electromechanical latch is configured to:

receive the first electronic control signal from the switching element;

receive a second electronic control signal from an electronic gaming machine associated with the electronic gaming machine cabinet; and lock or unlock the access door based on the first electronic control signal and the second electronic control signal.

19. The system of claim 18, further comprising a processor, wherein the processor is configured to perform operations comprising transmitting a control signal to the electromechanical latch that causes the electromechanical latch to at least one of open or close.

20. The system of claim 19, wherein the processor is further configured to perform operations comprising transmitting the electronic control signal to the electromechanical latch to allow access to the cabinet independent of operation of the switching element.

* * * * *